US005653920A

United States Patent [19]

DiDomenico

[11] Patent Number: 5,653,920

[45] Date of Patent: Aug. 5, 1997

[54] HUMIDIFICATION DEVICE

[75] Inventor: Nicholas F. DiDomenico, Mertztown, Pa.

[73] Assignee: Bayer Corporation, Tarrytown, N.Y.

[21] Appl. No.: 664,354

[22] Filed: Jun. 17, 1996

Related U.S. Application Data

[63] Continuation of Ser. No. 401,565, Mar. 9, 1995, abandoned.

[51] Int. Cl.[6] ..... B01F 3/04

[52] U.S. Cl. ..... 261/104; 239/43; 312/21.01

[58] Field of Search ..... 261/104; 239/43, 239/53; 312/31.05, 31.01, 31.03

[56] References Cited

U.S. PATENT DOCUMENTS

| | | | |
|---|---|---|---|
| 1,012,494 | 12/1911 | Wilson | 261/104 |
| 1,273,682 | 7/1918 | Slater et al. | 239/43 |
| 1,381,064 | 6/1921 | Dixon | 312/31.03 |
| 1,537,090 | 5/1925 | Smith | 239/43 |
| 2,028,330 | 1/1936 | Hudson | 312/31.01 |
| 2,219,959 | 10/1940 | Laidley | 239/43 |
| 2,634,112 | 4/1953 | Snow | 39/43 |
| 3,030,161 | 4/1962 | Bushong | 312/31.01 |
| 3,409,219 | 11/1968 | Behnke | 261/104 |
| 3,532,270 | 10/1970 | Schoen, Jr. | 261/104 |
| 3,801,011 | 4/1974 | Guehler et al. | 239/53 |
| 4,098,852 | 7/1978 | Christen | 261/104 |
| 4,381,267 | 4/1983 | Jackson | 261/104 |
| 4,428,892 | 1/1984 | Berliner | 261/104 |
| 4,708,831 | 11/1987 | Elsworth et al. | 261/104 |
| 5,273,689 | 12/1993 | Hamasaki | 261/104 |
| 5,318,731 | 6/1994 | Yokoya et al. | 261/104 |

*Primary Examiner*—Tim R. Miles
*Attorney, Agent, or Firm*—Rodman & Rodman

[57] ABSTRACT

The humidification device includes a tube formed of gas permeable material connected to a water source by a tube formed of material that is substantially impermeable to water. The gas permeable tube permits water to evaporate through the tube wall and is thus an evaporation tube. The evaporation tube is disposed in a chamber that is to be humidified. As water evaporates from the evaporation tube, the humidity in the chamber builds up to a maximum level. At the maximum humidity level evaporation of water from the evaporation tube ceases. When the humidity level in the chamber drops below the maximum level, evaporation of water from the evaporation tube resumes to restore the humidity in the chamber to its maximum level. Water flow from the water source replaces evaporated water from the evaporation tube. The humidification device is thus self-regulating and does not require any water flow regulating devices. One or more water flow tubes can be connected to the evaporation tube from a water source.

3 Claims, 1 Drawing Sheet

HUMIDIFICATION DEVICE

This is a continuation of application Ser. No. 08/401,565, filed Mar. 9, 1995 abandoned.

BACKGROUND OF THE INVENTION

This invention is directed to humidification devices and more particularly to a novel self-regulating humidification device for providing a fixed level of humidity in a chamber.

The invention is applicable to humidifying a space of limited size such as a room or chamber, and is particularly applicable to humidification of reagent chambers. Humidification of such chambers is desirable to retard evaporation of reagents that are maintained in open vials for aspiration during analytical processing of fluids, such as blood serum.

One well known approach to humidifying a space includes the use of a water absorbent element such as a curtain. The curtain is either stationary or movable and constitutes an evaporation surface for transmitting water vapor into the space or chamber. Examples of such devices are shown in U.S. Pat. Nos. 470,424; 1,514,564; and 2,253,237.

Other known humidification devices include porous distributing tubes combined with water flow regulators. Examples of such devices are shown in U.S. Pat. Nos. 1,942,780; 1,944,375; and 1,537,090. In some instances, heat is used in a humidifier to foster evaporation, as shown in U.S. Pat. No. 3,482,929. In other instances, humidification is achieved by depositing water on a surface such as a glass slide and permitting the deposited water to vaporize into a chamber, as shown in U.S. Pat. No. 4,824,788.

In nearly all known humidifiers, except where an open container of water is positioned in a fixed location for evaporation, a humidification device will generally include moving parts or regulating devices that require monitoring.

Humidification devices that are self-regulating often include control valves, intricate operating devices, or other complex regulating components that ensure an adequate feeding of water to the humidifying component.

It is thus desirable to provide a humidifying device that is of simple construction with no moving parts and is self-regulating to replenish water in the device and to maintain a desired humidity level in a chamber.

OBJECTS AND SUMMARY OF THE INVENTION

Among the several objects of the invention may be noted the provision of a novel humidification device, a novel humidification device that is self-regulating, a novel self-regulating humidification device wherein a humidifying element is formed of a gas permeable material, a humidification device that evaporates water into a confined chamber until the humidity in the chamber prevents further evaporation to maintain a humidity control in the chamber, and a novel method of self-regulating the humidity in a chamber.

Other objects and features of the invention will be in part apparent and in part pointed out hereinafter.

In accordance with the present invention, the humidification device includes a water conduction means for conducting water from a water source to a chamber for humidification of the chamber. The water conduction means include a water flow member, such as a tube, formed of material that is impermeable to water. The water flow member is connected to the water source and to a second tube that is formed of gas permeable material that permits passage of water vapor but not liquid. Thus, the gas permeable material permits evaporation of water through the walls of the tube to a region of relatively low concentration of water molecules. Since the second tube is filled with water, the inside of the tube is a region of high concentration of water molecules. Thus, water will not pass from a region of low concentration outside the second tube to a region of high concentration inside the second tube. Therefore, the second tube, when filled with water, operates as a one-way evaporation element or tube.

The one-way evaporation tube is disposed in a chamber that is to be humidified, such as a chamber that contains open vials of reagents, wherein an elevated humidity level is needed to retard evaporation of such reagents.

The impermeable water flow tube connected to the water source permits water to flow to the one-way evaporation tube without any separate flow regulation device. Water flow can be simply accomplished by gravity feed of water from a water source, such as a reservoir, into the one-way evaporation tube. The one-way evaporation tube can have a closed end such that when the one-way evaporation tube is full, no additional water can flow into the tube.

However, when water evaporates from the one-way evaporation tube, it is replaced by water from the water source that flows through the water flow tube and into the one-way evaporation tube. The humidification system is thus self-regulating insofar as replenishing water in the one-way evaporation tube.

The humidity level in the humidification chamber will determine the rate of evaporation of water from the one-way evaporation tube. Thus, a relatively low humidity level in the humidification chamber will result in a relatively high rate of water evaporation from the one-way evaporation tube. A relatively high humidity level in the humidification chamber will result in a relatively low rate of water evaporation from the one-way evaporation tube.

When a maximum humidity level is reached in the humidification chamber, evaporation of water from the one-way evaporation tube essentially stops. Once the maximum humidity level in the chamber drops, evaporation of water from the one-way evaporation tube resumes until the predetermined maximum humidity level is again reached. In general, the rate of evaporation of water from the one-way evaporation tube is a function of the existing humidity level in the chamber, the evaporation area of the tube surface and the pore density of the tubing. The humidification device is thus self-regulating insofar as maintaining a maximum humidity level in the chamber, and requires no monitoring.

The one-way evaporation tube can be removably disposed in a humidification chamber or it can be combined with the humidification chamber so as to be nonremovable.

The water supply can simply be a replenishable reservoir or an open faucet that ensures a continuous supply of water.

If desired, the one-way evaporation tube can have more than one water flow connection from the water supply.

The invention accordingly comprises the constructions and method hereinafter described, the scope of the invention being indicated in the claims.

DESCRIPTION OF THE DRAWINGS

In the accompanying drawings.

Corresponding reference characters indicate corresponding parts throughout the several views of the drawings.

DETAILED DESCRIPTION OF THE INVENTION

Figure 1:
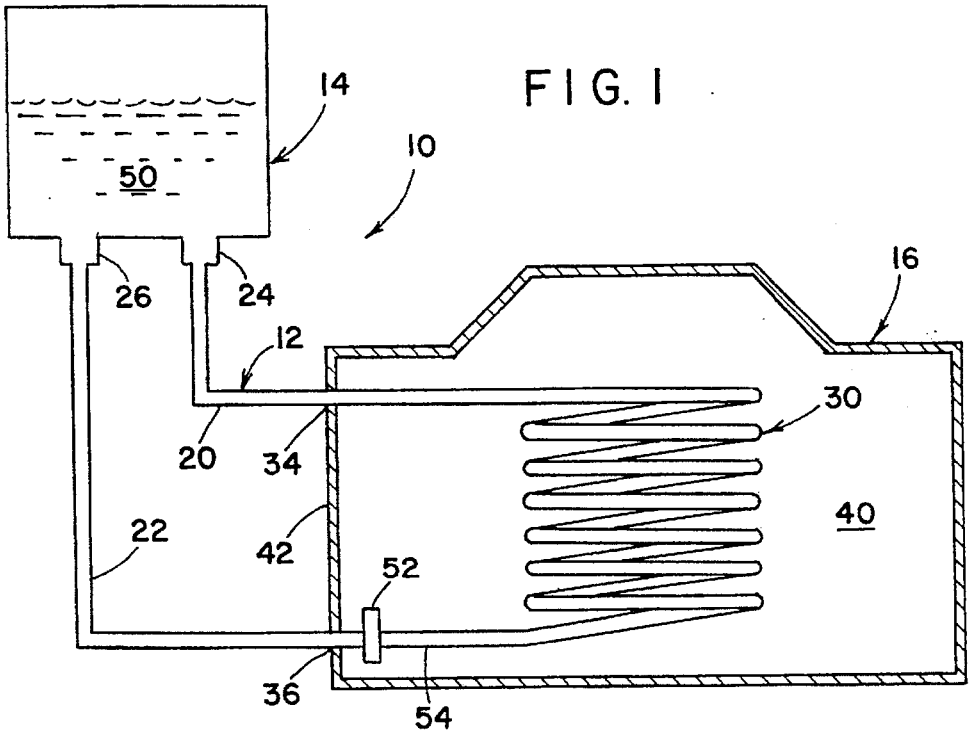
FIG. 1 is a simplied schematic view of a humidification device incorporating one embodiment of the present invention.

A humidification device incorporating one embodiment of the invention is generally indicated by the reference number 10 in FIG. 1. The humidification device 10 includes water conduction means 12 for directing water from a water source 14 to a chamber 16 for humidification of the chamber.

The water conduction means 12 includes a pair of tubular sections 20 and 22, connected at one end to the water source 14 via any suitable known connection members 24 and 26. If desired, the connection members 24 and 26 can include a shut-off valve. The tubular sections 20 and 22 have walls that are substantially impermeable to water and can be formed of any suitable known flexible or inflexible plastic material.

The opposite ends of the tubular sections 20 and 22 are connected to a tubular section 30 disposed in the chamber 16. The wall of the tubular section 30 is formed of a gas permeable material that permits water vapor to pass from a region of high molecular concentration to a region of low molecular concentration. Thus, when water is inside the tube 30, the water will evaporate to the outside of the tube 30 through the wall of the tube 30, and constitutes a one-way evaporation tube. Thus, with vapor on the outside and water on the inside, the gas permeable or one-way evaporation tube 30 prevents vapor from passing through the tube wall to the interior of the tube 30. The tubular section 30 can be made of any suitable known gas-permeable material that permits water vapor to pass from a region of high molecular concentration to a region of low molecular concentration, such as, for example, Gore-Tex®, manufactured by Gore-Tex Inc. of Elkton, Md.

The tubular sections 12, 22 and 30 are joined together in leak-tight fashion, as shown in FIG. 1, in any suitable known manner.

Preferably the one-way evaporation tube 30 is arranged in a coil form in the chamber 16 to facilitate disposition of a selected amount of evaporation surface area of the tube 30 in the chamber 16.

The chamber 16 is, for example, a suitable known reagent chamber containing open vials of reagent (not shown) used for analytical purposes. The chamber 16 can include a lid (not shown) or a port (not shown) permitting access to an interior space 40 of the chamber 16.

The tubes 20 and 22 can be arranged to pass directly through a wall 42 of the chamber 16. Any suitable known sealing means are provided at the junctions 34 and 36 between the tubes 20 and 22 with the wall 42.

If desired, known hanger members (not shown) or other conventional tube supporting structure can be provided in the chamber 16 to support the one-way evaporation tube 30 in coiled arrangement or in any other suitable support arrangement.

In using the humidification device 10, water 50 in the water source 14 is gravity fed through the connection members 24 and 26 into the tubes 20 and 22 for flow into the one-way evaporation tube 30, thereby filling the tube 30 with water.

Figure 2:
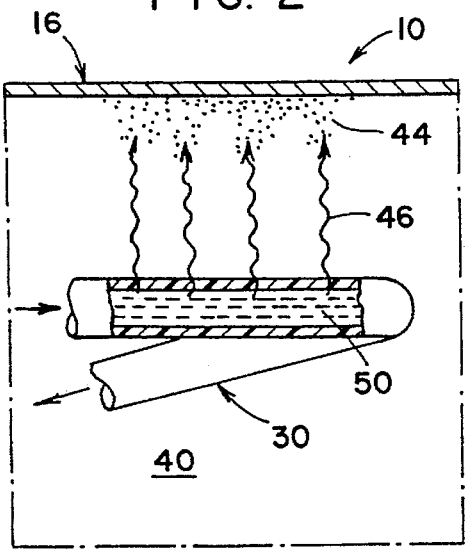
FIGS. 2 and 3 are enlarged fragmentary views, partly shown in section, of the humidification device.
Figure 3:
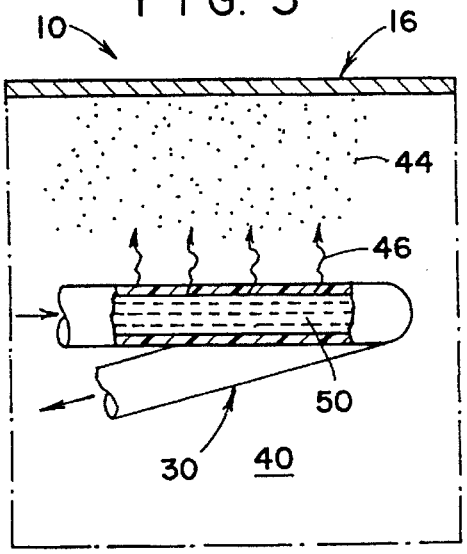

The gas permeable wall of the one-way evaporation tube 30 permits water to evaporate from inside the tube 30 to the outside by passing water vapor through the wall of the tube 30, as shown schematically in FIGS. 2 and 3. Thus, water does not flow freely through or absorb freely into the walls of the tube 30. When water evaporates through the wall of the one-way evaporation section 30 the vaporized water is confined within the chamber space 40 to humidify the chamber 16.

As the humidity level 44 in the chamber space 40 increases to a maximum level, evaporation of water from the tube 30, indicated by the arrows 46, slows down. FIG. 2 shows a relatively high rate of vaporization for relatively low humidity levels, and FIG. 3 shows a relatively low rate of vaporization for relatively high humidity levels.

When the humidity level 44 in the chamber 16 reaches a predetermined maximum level, the humidity of the space 40 prevents further evaporation of water from the one-way evaporation tube 30. Thus, the chamber space 40 in the chamber 16 can be maintained at a maximum humidity level without any separate regulating device.

Should the humidity level in the chamber space 40 drop, evaporation of water from the tubular section 30 will resume until the maximum humidity level in the chamber space 40 is reached once again.

The humidity level in the chamber 16 is thus self-regulated and does not require moving parts or intricate regulating mechanisms.

To ensure that water continuously remains in the tubular section 30 over a prolonged period of time, the tubular sections 20 and 22 can be connected to water faucets (not shown) that are maintained in an open position.

If a humidification space is kept open to permit some escape of humidity, then the one-way evaporation tube 30 may evaporate water continuously.

In another embodiment of the invention, an optional closure device 52 (FIG. 1) of any suitable known construction is provided at an end portion 54 of the one-way evaporation tube 30 to close off flow at the end portion 54.

Under this arrangement, water is fed into the one-way evaporation tube 30 only from the water flow tube 20. Thus, if desired, the tube section 22 can be eliminated. In all other respects, operation of the humidification device, without the tube section 22, is similar to that as previously described.

As will be apparent to those skilled in the art, the one-way evaporation tube 30 can be disposed in the humidification chamber through a lid portion (not shown) of the chamber 14. Under this arrangement, installation and removal of the one-way evaporation tube 30 from the chamber 16 can be easily accomplished. If desired, appropriate sealing means can be provided around the lid to ensure that the chamber space 40 does not communicate with the outside air.

In some instances, it may be desirable to combine the one-way evaporation tube 30 with the chamber 16 such that the one-way evaporation tube 30 forms a permanent part of the chamber 16. Such combination can be accomplished in any suitable known manner.

Some advantages of the invention evident from the foregoing description include a humidification device that is simple to manufacture and easy to maintain. No skill is necessary to operate the humidification device since it is self-regulating and requires little or no monitoring. The elimination of timers, valves, curtains, heaters and other known mechanisms and components used in known humidification devices ensures simple and consistent operation of the device 10.

As water does not flow freely through the walls of the one-way evaporation tube 30, there is no need for catch basins for excess water. Evaporation is controlled based on the humidity in the chamber, and there is no need for intermediate flow control devices for feeding water to the vaporization tube. Water flow from the water supply into the one-way evaporation tube is kept at a rate that is based on the rate of water evaporation from the one-way evaporation tube 30.

Thus, a simple, self-regulating humidification system is provided, wherein evaporation of reagent materials, for example, is reduced by controlling the humidity in a humidification chamber.

In view of the above, it will be seen that the several objects of the invention are achieved and other advantageous results attained.

As various changes can be made in the above constructions and method without departing from the scope of the invention, it is intended that all matter contained in the above description or shown in the accompanying drawings shall be interpreted as illustrative and not in a limiting sense.

What is claimed is:

1. A method of self-regulating humidification in an enclosed chamber of portable size comprising, a) joining a tube formed of gas permeable imperforate material to a tube formed of nonpermeable material to permit water flow from one of the tubes to the other tube, b) connecting the nonpermeable tube to a water source that is separate and apart from an enclosed chamber of portable size, such that the water source is outside the chamber structure, and water flows from the water source through the nonpermeable tube and into the imperforate gas permeable tube, c) disposing the imperforate gas permeable tube in the enclosed portable size chamber which is to be humidified such that the enclosed portable size chamber is spaced from the water source and need not be opened to obtain access to the water source, and the imperforate gas permeable tube need not be manipulated to obtain access to the water source, d) preventing water that is in the imperforate gas permeable tube and the nonpermeable tube from escaping to the environment outside of the enclosed portable size chamber, and e) humidifying the enclosed portable size chamber by permitting water that flows into the nonpermeable tube from the water source to evaporate through the wall of the imperforate gas permeable tube and permitting the evaporated water to distribute in the enclosed portable size chamber without the influence of an air circulation device such as a fan or blower until the humidity in the enclosed portable size chamber reaches a maximum humidity level that prevents further evaporation of water through the wall of the imperforate gas permeable tube, whereby further evaporation of water through the wall of the imperforate gas permeable tube can occur only to replace humidity in the enclosed portable size chamber when the humidity level of the enclosed portable size chamber drops below a maximum attainable humidity level.

2. The method of claim 1 wherein the step of preventing escape of water from the tubes includes closing off a part of the gas permeable tube.

3. The method of claim 1 wherein the step of preventing escape of water from the tubing includes joining another tube to an opposite end of the gas permeable tube and arranging the other tube to communicate with the water source.

* * * * *